US008468854B2

(12) United States Patent
Yang

(10) Patent No.: US 8,468,854 B2
(45) Date of Patent: Jun. 25, 2013

(54) SINKER

(71) Applicant: Cheng-Pin Yang, Taoyuan County (TW)

(72) Inventor: Cheng-Pin Yang, Taoyuan County (TW)

( * ) Notice: Subject to any disclaimer, the term of this patent is extended or adjusted under 35 U.S.C. 154(b) by 0 days.

(21) Appl. No.: 13/646,767

(22) Filed: Oct. 8, 2012

(65) Prior Publication Data

US 2013/0098117 A1 Apr. 25, 2013

(30) Foreign Application Priority Data

Oct. 19, 2011 (TW) ..... 100219565 U

(51) Int. Cl.
*D04B 15/06* (2006.01)

(52) U.S. Cl.
USPC ..... 66/93

(58) Field of Classification Search
USPC ..... 66/91, 92, 93, 104, 107, 108 A, 108 R
See application file for complete search history.

(56) References Cited

U.S. PATENT DOCUMENTS

| | | | | |
|---|---|---|---|---|
| 2,080,377 | A * | 5/1937 | Nebel | 66/93 |
| 2,284,454 | A * | 5/1942 | Smith, Jr. | 66/194 |
| 2,320,989 | A * | 6/1943 | Weinberg | 66/12 |
| 4,926,660 | A * | 5/1990 | Takashi | 66/9 R |
| 5,390,511 | A * | 2/1995 | Shibata et al. | 66/9 R |
| 5,477,707 | A * | 12/1995 | Renda et al. | 66/93 |
| 5,511,393 | A * | 4/1996 | Hu | 66/93 |
| 6,321,575 | B1 * | 11/2001 | Sangiacomo | 66/93 |
| 6,705,129 | B2 * | 3/2004 | Pot d'Or | 66/93 |
| 6,715,325 | B2 * | 4/2004 | Sangiacomo | 66/107 |
| 6,840,065 | B1 * | 1/2005 | Wang | 66/93 |

* cited by examiner

*Primary Examiner* — Danny Worrell
(74) *Attorney, Agent, or Firm* — Alan Kamrath; Kamrath IP Lawfirm, P.A.

(57) ABSTRACT

The main objective of the present invention is to provide a sinker that can produce pile loops of different lengths. The sinker has a nib and a belly formed separately on one end thereof. A throat is formed between the nib and the belly. The nib has a bulge formed on a top edge thereof. The throat has a recess formed on a top edge of the belly. With the bulge and the recess, multiple vertical gaps of different lengths are provided. When yarns are placed at different relative positions, pile loops of different lengths are made by the same sinker. Thus, the sinker results in fabrics with variant appearances and good tactile impression.

4 Claims, 14 Drawing Sheets

SINKER

BACKGROUND OF THE INVENTION

1. Field of the Invention

The present invention relates to a sinker for a knitting machine, especially to a sinker that is used to produce loop piles of various lengths.

2. Description of the Prior Arts

Sinkers are important elements for the knitting machine. With the sinkers and the bearded needles reciprocating axially and transversely in the knitting machine, yarn loops are knitted. The sinkers have predetermined configuration and are arranged radially in the knitting machine, wherein the sinkers are arranged at intervals alternately with one longer sinker and one shorter sinker or with one protrusion.

With reference to FIG. 12, a conventional sinker is elongated and has a belly 31 and a nib 30 formed on one end thereof. The end of the nib 30 protrudes upward slightly. A throat 32 is formed between the nib 30 and the belly 31 and has two flat sidewalls. The conventional sinker has a butt 33 formed on another end thereof. A protrusion 34 is formed on a top edge of the butt 33.

With further reference to FIG. 13, when two yarns 40, 41 on the needles are mounted in the throat 32, the yarns 40, 41 are located at the same horizontal position so that the yarns 40, 41 are knitted to a smooth fabric. With further reference to FIG. 14, when one yarn 40 on the needle is mounted in the throat 32 while the other yarn 41 on the needle is mounted on the nib 30, a vertical gap is formed between the yarns 40, 41 so that a pile loop having the same length with the gap is knitted.

However, the conventional sinker can only knit smooth fabric or fabric with pile loops having uniform length such that the appearance and the tactile impression of the fabric are monotonous. If the user needs different pile loops of different lengths, the user needs to change different conventional sinkers of different sizes and still cannot have different pile loops of different lengths in the same fabric.

To overcome the shortcomings, the present invention provides a sinker to mitigate or obviate the aforementioned problems.

SUMMARY OF THE INVENTION

The main objective of the present invention is to provide a sinker that can produce pile loops of different lengths. The sinker has a nib and a belly formed separately on one end thereof. A throat is formed between the nib and the belly. The nib has a bulge formed on a top edge thereof. The throat has a recess formed on a top edge of the belly. With the bulge and the recess, multiple vertical gaps of different lengths are provided. When yarns are placed at different relative positions, pile loops of different lengths are made by the same sinker. Thus, the sinker results in fabrics with variant appearances and good tactile impression.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
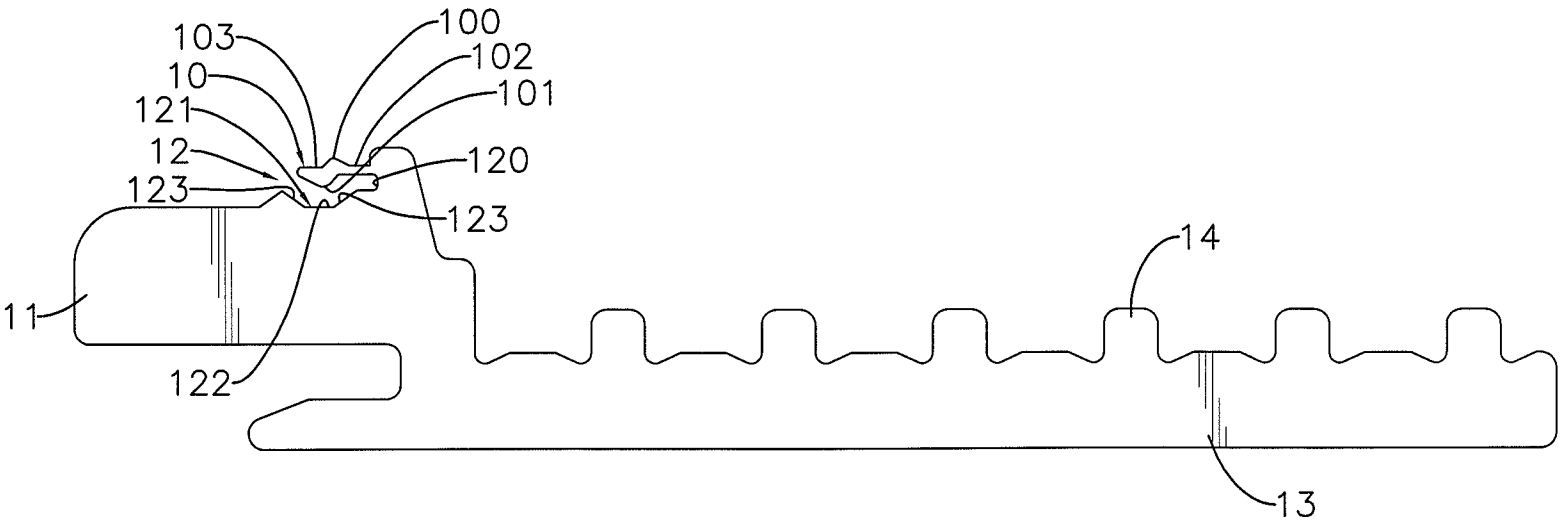
FIG. 1 is a side view of a sinker in accordance with the present invention.

With reference to FIG. 1, a sinker in accordance with the present invention is elongated and has a front end, a rear end, a nib 10, a belly 11, a throat 12 and a butt 13.

The nib 10 is formed on the front end and has a top edge, a bottom edge, an inner detent 102, an outer detent 103, a bulge 100 and a limit 101. The inner and outer detents 102, 103 are formed separately on the top edge of the nib 10. The bulge 100 is conical, is formed on the top edge of the nib 10 and is formed between the inner and outer detents 102, 103. The limit 101 is conical and is formed on the bottom edge of the nib 10.

The belly 11 is formed on the front end, is separate from the nib 10 and has a top edge facing the bottom edge of the nib 10.

The throat 12 is formed between the nib 10 and the belly 11 and has a closed end, an open end and a recess 121. The recess 121 is formed on the top edge of the belly 11 and has a bottom wall 122 and two inclined sidewalls 123. The bottom wall 122 is separate from the limit 101 of the nib 10. Therefore, multiple gaps of different lengths are formed between the top edge of the nib 10 and the top edge of the belly 11.

The butt 13 is formed on the rear end and has a top edge and at least one protrusion 14. The at least one protrusion is formed on the top edge of the butt 13. In a preferred embodiment, the butt 13 has multiple protrusions 14 formed separately on the top edge of the butt 13.

Figure 2:
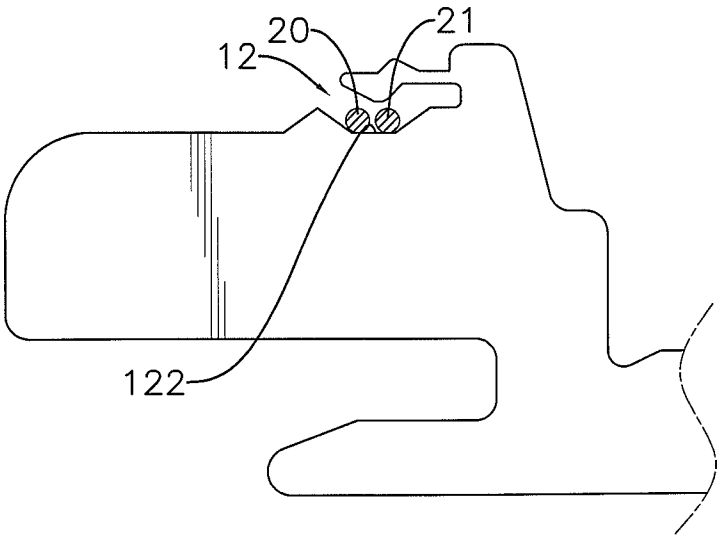
FIG. 2 is an operational enlarged side view of the sinker in FIG. 1 with yarns.

With reference to FIG. 2, the needles and the sinker as described and used in a knitting machine move vertically and horizontally. When two yarns 20, 21 on the needles are mounted on the bottom wall 122 of the throat 12, the yarns 20, 21 are located at the same horizontal position so that the yarns 20, 21 are knitted to a smooth fabric.

Figure 3:
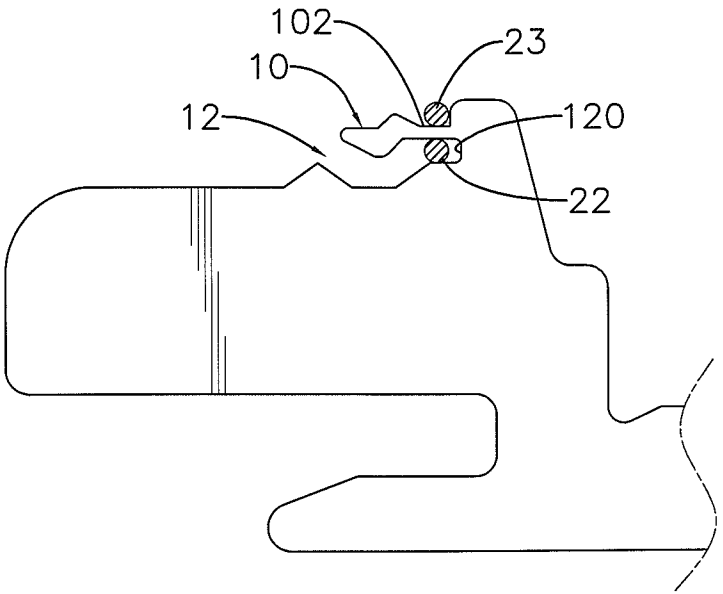
FIG. 3 is another operational enlarged side view of the sinker in FIG. 1 with yarns.

With reference to FIG. 3, when one yarn 22 on the needle is mounted on the closed end 120 of the throat 12 while the other yarn 23 on the needle is mounted on the inner detent 102 of the nib 10, a vertical gap is formed between the yarns 22, 23 so that a pile loop having the same length with the gap is knitted.

Figure 4:
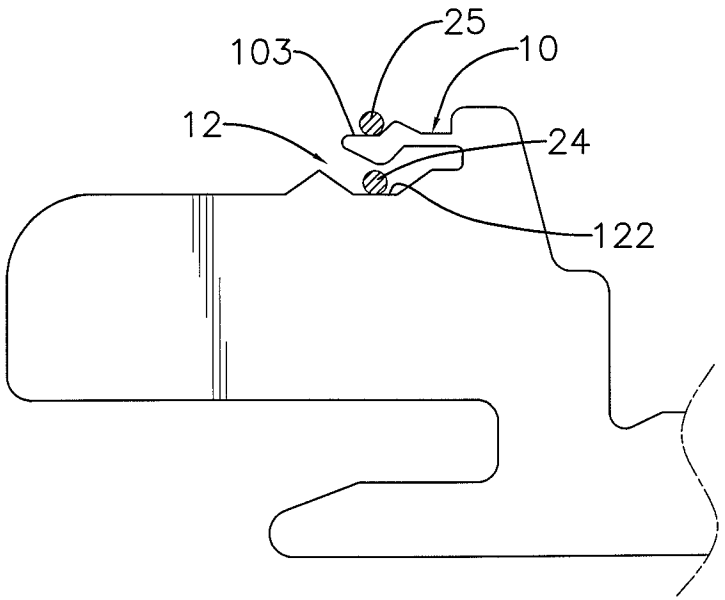
FIG. 4 is another operational enlarged side view of the sinker in FIG. 1 with yarns.
Figure 5:
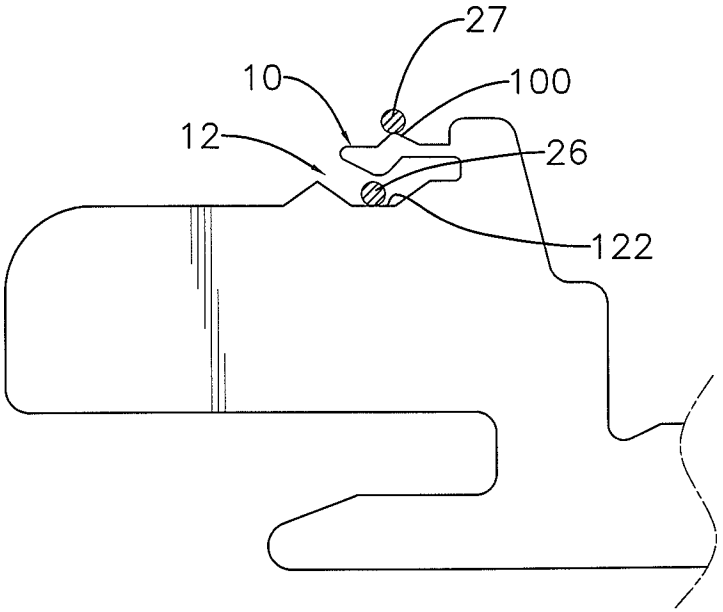
FIG. 5 is another operational enlarged side view of the sinker in FIG. 1 with yarns.

With further reference to FIGS. 4 and 5, when one yarn 24, 26 is mounted on the bottom wall 122 of the throat 12 while the other yarn 25, 27 is mounted on the outer detent 103 or the bulge 100 of the nib 10, different pile loops of different lengths are knitted since the lengths of the gap between the bottom wall 122 and the outer detent 103 and the gap between the bottom wall 122 and the bulge 100 are different. Therefore, fabrics 28, 28A, 28B, 28C as shown in FIGS. 8 to 11 with longer pile loops 281, 281A, 281B, 281C and shorter pile loops 282, 282A, 282B, 282C are easily knitted.

Figure 6:
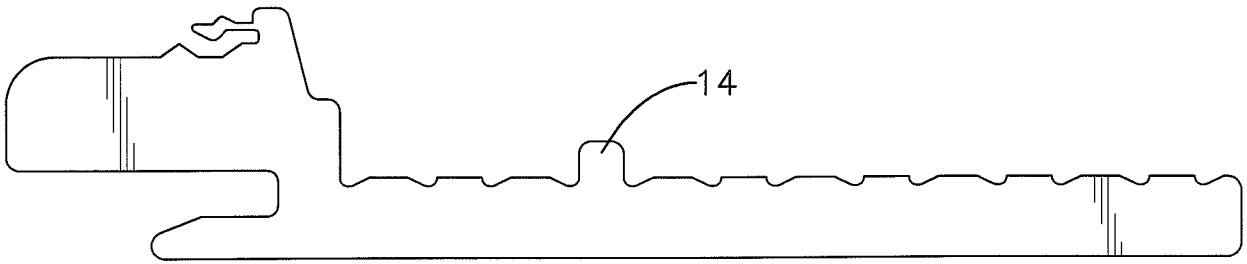
FIG. 6 is an operational side view of the sinker in FIG. 1, shown having only one protrusion.
Figure 7:
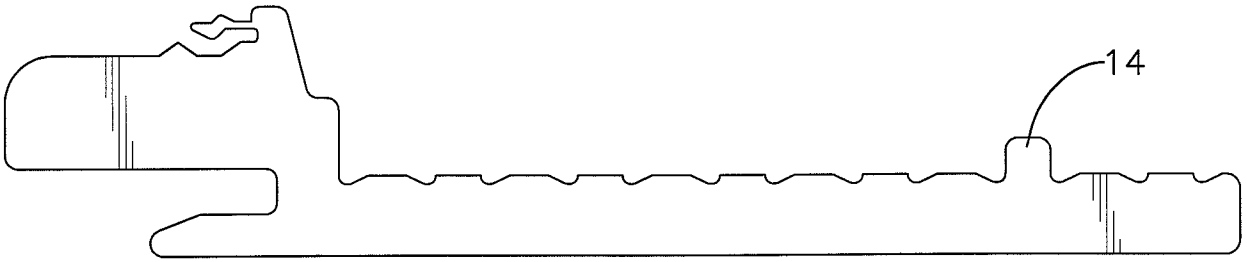
FIG. 7 is another operational side view of the sinker in FIG. 1, shown having only one protrusion.
Figure 8:
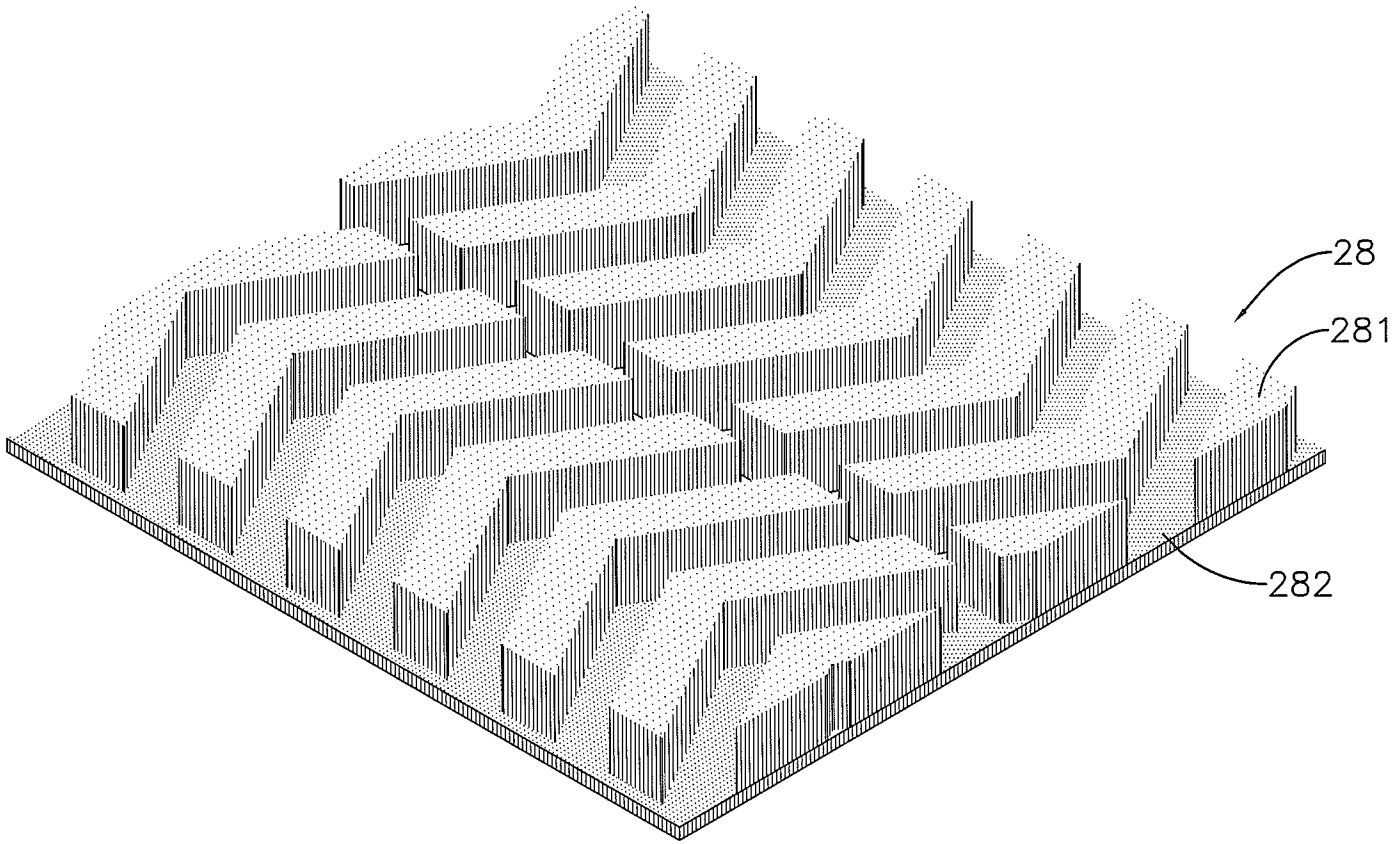
FIG. 8 is a perspective view of a fabric knitted by the sinker in FIG. 1.
Figure 9:
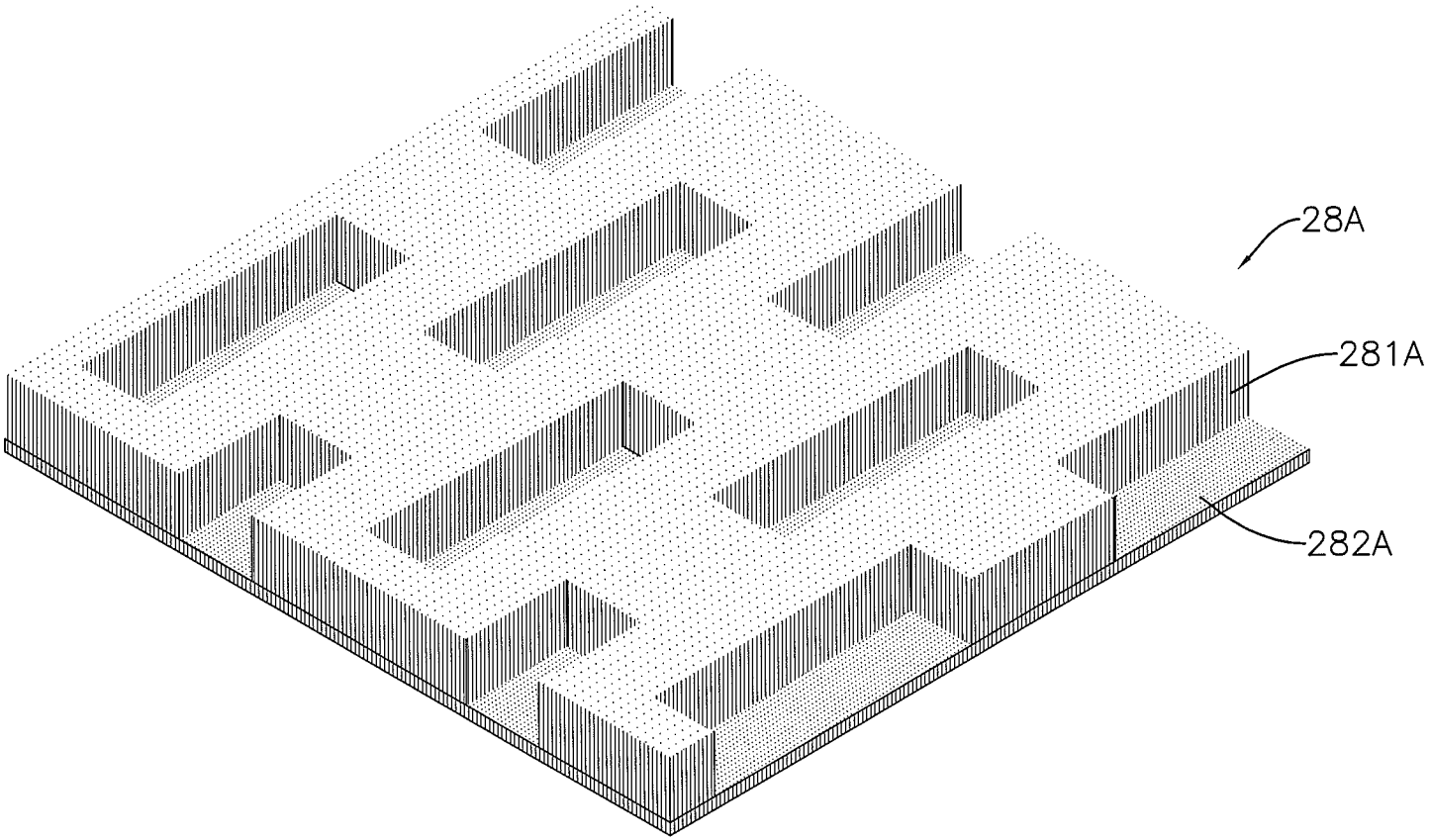
FIG. 9 is a perspective view of another fabric knitted by the sinker in FIG. 1.
Figure 10:
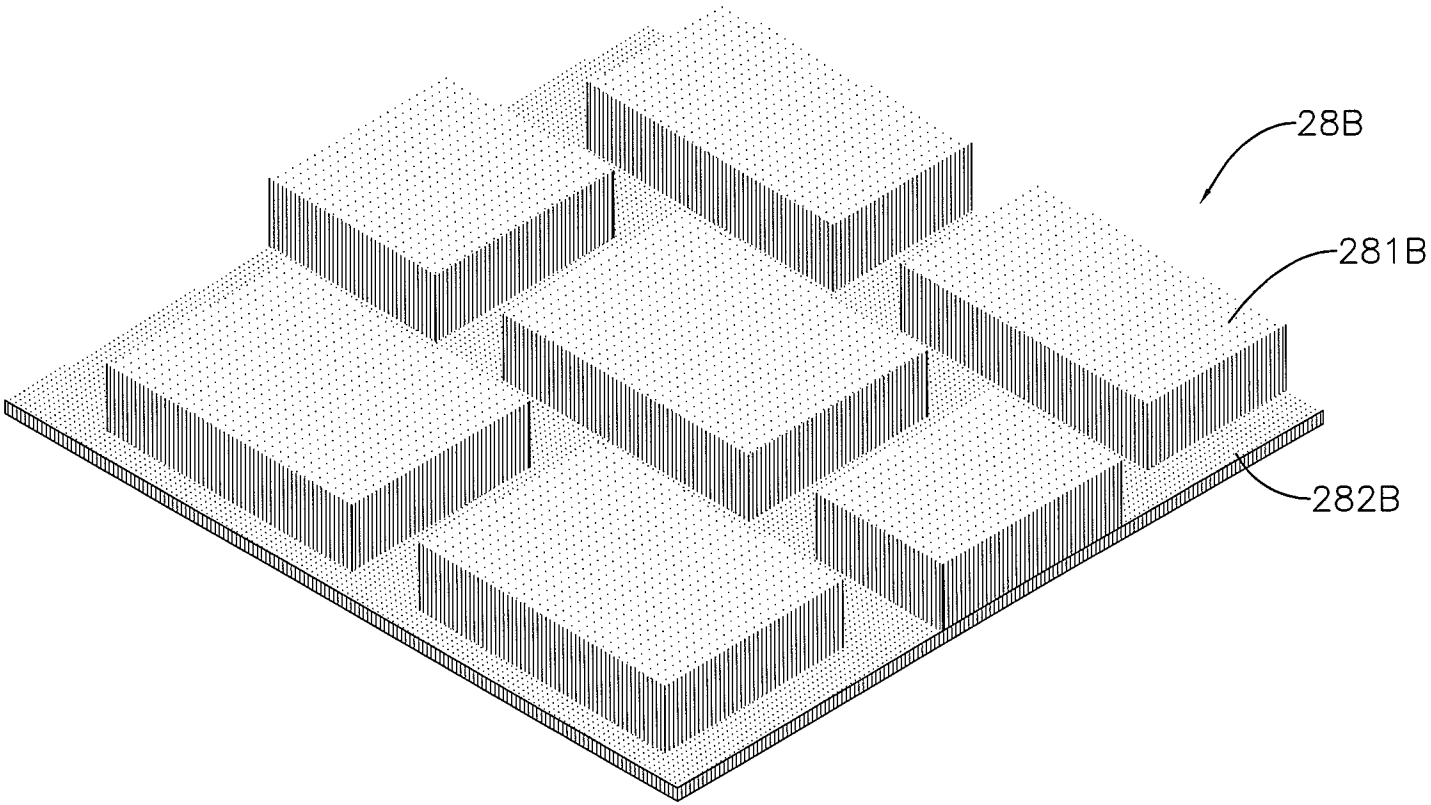
FIG. 10 is a perspective view of further another fabric knitted by the sinker in FIG. 1.
Figure 11:
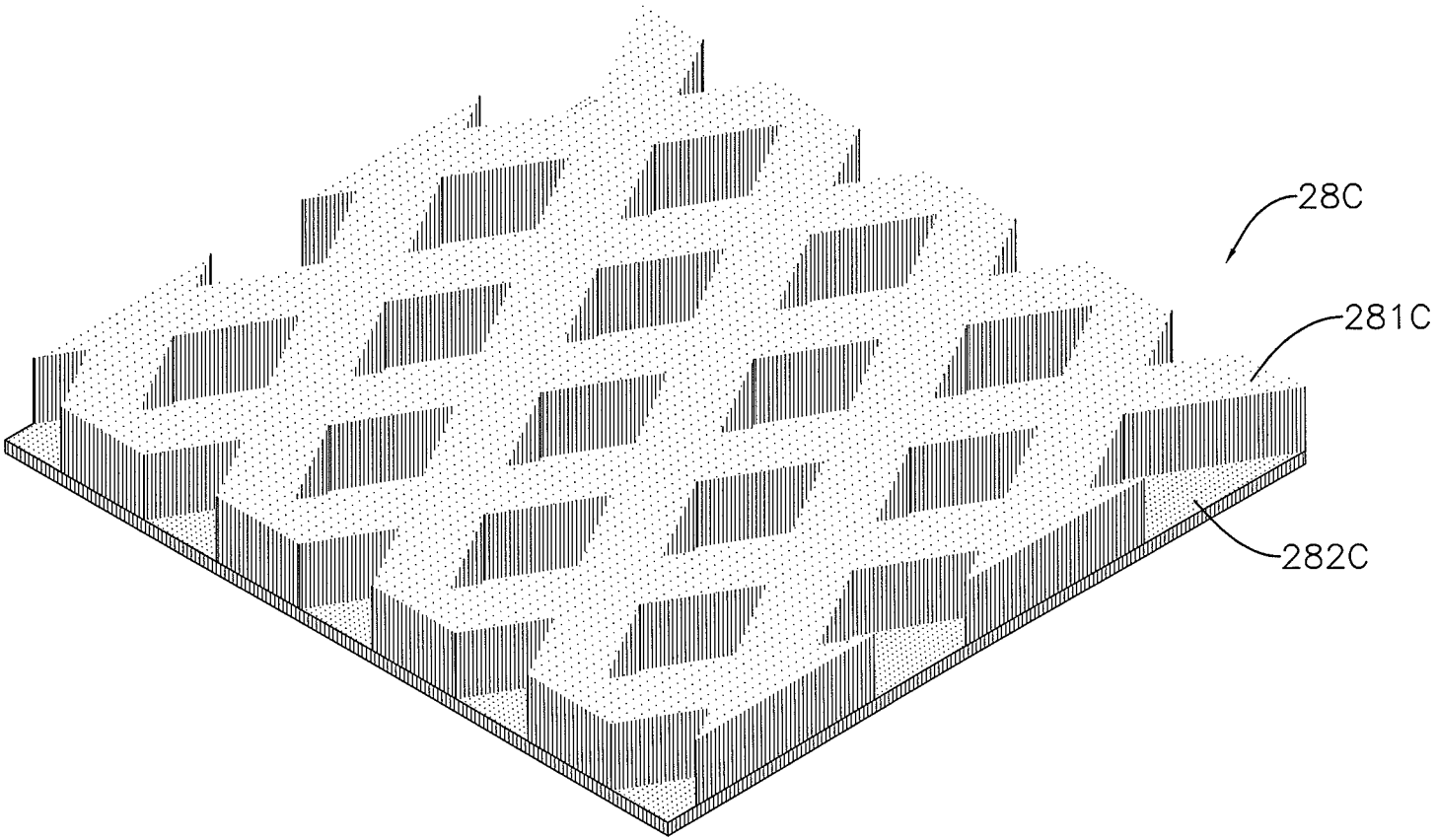
FIG. 11 is a perspective view of still another fabric knitted by the sinker in FIG. 1.
Figure 12:
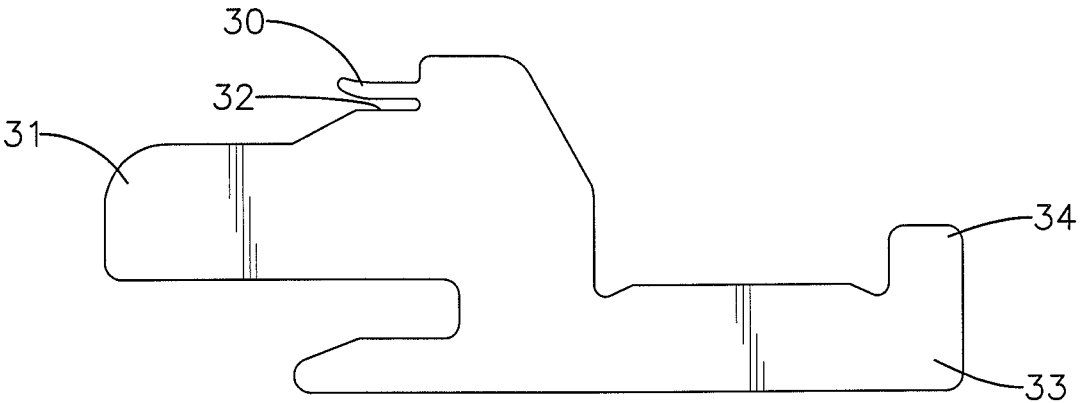
FIG. 12 PRIOR ART
FIG. 12 is a side view of a conventional sinker in accordance with the prior art.
Figure 13:
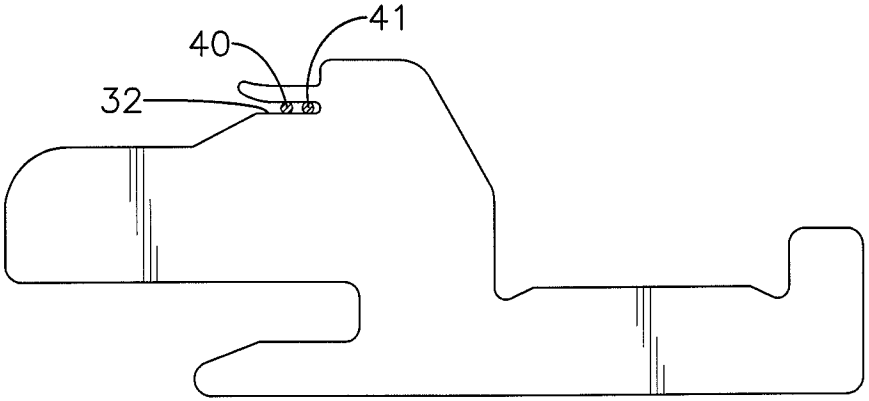
FIG. 13 PRIOR ART
FIG. 13 is an operational side view of the conventional sinker in FIG. 12 with yarns.
Figure 14:
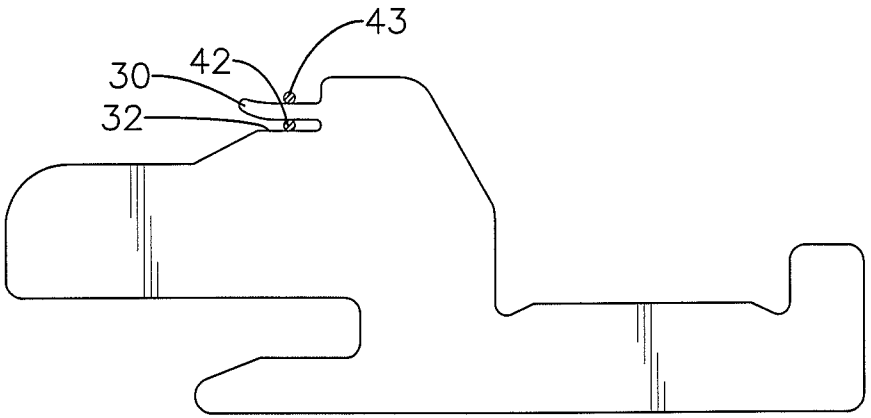
FIG. 14 PRIOR ART
FIG. 14 is another operational side view of the conventional sinker in FIG. 12 with yarns.

When different lengths of the sinkers as described are needed, the user may cut unused protrusions 14 to make the sinker have a desired length. With reference to FIGS. 6 and 7, the user cuts the protrusions 14 at different parts of the butt to have the sinker of different sizes.

The sinker as described has the following advantages. Because of the bulge 100 and the recess 121, multiple vertical distances are formed between the top edge of the nib 10 and the top edge of the belly 11. Therefore, one single sinker as described can provide multiple vertical gaps of different lengths so that pile loops of different lengths can be knitted on the same fabric without changing the sinker. Further, with the limit 101 of the nib 10, vertical gaps with even more lengths are provided. Thus, the sinker as described results in fabrics with variant appearances and good tactile impression.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A sinker comprising:

a front end;

a rear end;

a nib formed on the front end and having a top edge;

a bottom edge;

an inner detent and an outer detent formed separately on the top edge of the nib; and a bulge being conical, formed on the top edge of the nib and formed between the inner and outer detents;

a belly formed on the front end, being separate from the nib and having a top edge facing the bottom edge of the nib;

a throat formed between the nib and the belly and having a closed end;

an open end; and a recess formed on the top edge of the belly and having a bottom wall and two inclined sidewalls; and a butt formed on the rear end and having a top edge and at least one protrusion formed on the top edge of the butt.

2. The sinker as claimed in claim 1, wherein the nib has a limit being conical and formed on the bottom edge of the nib; and the bottom wall is separate from the limit of the nib.

3. The sinker as claimed in claim 1, wherein the butt has multiple protrusions formed separately on the top edge of the butt.

4. The sinker as claimed in claim 2, wherein the butt has multiple protrusions formed separately on the top edge of the butt.

* * * * *